US007108756B2

(12) United States Patent
Lippmann et al.

(10) Patent No.: US 7,108,756 B2
(45) Date of Patent: Sep. 19, 2006

(54) METHOD FOR HEAT-TREATING WORK PIECES MADE OF TEMPERATURE-RESISTANT STEELS

(75) Inventors: Nils Lippmann, Rutesheim (DE); Wolfgang Lerche, Kleve (DE)

(73) Assignee: Robert Bosch GmbH, Stuttgart (DE)

( * ) Notice: Subject to any disclaimer, the term of this patent is extended or adjusted under 35 U.S.C. 154(b) by 193 days.

(21) Appl. No.: 10/432,751

(22) PCT Filed: Sep. 24, 2002

(86) PCT No.: PCT/DE02/03582

§ 371 (c)(1),
(2), (4) Date: Oct. 22, 2003

(87) PCT Pub. No.: WO03/027349

PCT Pub. Date: Apr. 3, 2003

(65) Prior Publication Data

US 2004/0055670 A1 Mar. 25, 2004

(30) Foreign Application Priority Data

Sep. 25, 2001 (DE) ..... 101 47 205

(51) Int. Cl.
*C23C 8/02* (2006.01)
*C23C 8/26* (2006.01)

(52) U.S. Cl. ..... 148/223; 148/226; 148/232

(58) Field of Classification Search ..... 148/205, 148/223, 226, 232
See application file for complete search history.

(56) References Cited

U.S. PATENT DOCUMENTS 2,408,623 A * 10/1946 Gilbert ..... 427/329
2,851,387 A 9/1958 Low
4,235,857 A * 11/1980 Mangels ..... 423/344
4,793,871 A * 12/1988 Dawes et al. ..... 148/218
5,176,760 A * 1/1993 Young ..... 148/222
6,006,819 A * 12/1999 Shimizu et al. ..... 164/100
6,168,095 B1 1/2001 Seitter et al.
6,408,237 B1 6/2002 Cho

FOREIGN PATENT DOCUMENTS

| | | | |
|---|---|---|---|
| DE | 1 933 439 | | 1/1970 |
| DE | 36 33 490 | | 4/1987 |
| EP | 0 545 069 | | 6/1993 |
| EP | 0 995 639 | | 4/2000 |
| JP | 77018125 B | * | 5/1977 |
| JP | 53083940 A | * | 7/1978 |
| JP | 9-78223 | | 3/1997 |

OTHER PUBLICATIONS

Davis et al., The ASM Handbook, 1995, ASM International, vol. 4, 314-319, 387-388 and 711-725.*

* cited by examiner

*Primary Examiner*—Roy King
*Assistant Examiner*—Michael P. Alexander
(74) *Attorney, Agent, or Firm*—Kenyon & Kenyon LLP

(57) ABSTRACT

A method of producing a workpiece of a heat-resistant steel, such as hot forming tool steel, where the workpiece may be hardened and depassivated after mechanical machining and electrochemical treatment. The hardening including a reduction step, so that no depassivation need be performed by pickling, for example, before nitriding. The result of the hardening treatment is a favorable surface condition for stepwise nitriding.

30 Claims, No Drawings

METHOD FOR HEAT-TREATING WORK PIECES MADE OF TEMPERATURE-RESISTANT STEELS

FIELD OF THE INVENTION

The present invention relates to a method for heat treatment of a workpiece made of heat-resistant steel, in particular hot forming tool steel, the workpiece being hardened and nitrided after mechanical working and electrochemical treatment, reduction of the workpiece surface being performed during hardening without having to perform a pickling treatment before the subsequent nitriding.

BACKGROUND INFORMATION

Nozzle bodies for modern direct injection systems are used to an increasing extent at operating temperatures up to 450° C. High demands are therefore made on the strength of components and the wear resistance of nozzle bodies. Nitrided hot forming tool steel in particular is therefore used to manufacture the nozzle bodies. ECM (electrochemical machining) methods are used in the production of internal bores (pressure chambers) and for rounding. The ECM methods used for shaping and surface treatment of metal workpieces are performed in an electrolyte solution, the workpiece to be machined usually being connected as the anode and the tool being connected as the cathode. Electrochemical machining methods are used in particular for deburring, polishing, grinding and etching the surfaces of a workpiece. The workpieces formed by the ECM method are highly passive and are very difficult to treat by thermochemical diffusion methods, in particular nitriding, because more noble alloy elements such as Cr remain on the surface and/or oxide alloy elements become oxidized, forming metal oxides and metal hydroxides $Me_xO_y[OH]_z$.

To improve the nitridability of direct-injection nozzle bodies, it is conventional today to pickle passive surfaces before nitriding, in particular by using hydrochloric acid. However, pickling has some major disadvantages. Pickling with acid may cause pickling scars, which decrease the strength of the component. Furthermore, it is very difficult to reproduce the results of pickling, because the length of storage between machining, basic heat treatment and nitriding may vary. Furthermore, pickling results in a considerable additional cost which is attributable in particular to the cost of the installation used for pickling and the required labor cost. Pickled workpieces must also be cleaned after pickling by using a very complex special cleaning technique. Disposal of pickling solutions is also complicated. In addition, pickling with acid results in unwanted environmental pollution and has a negative effect on working conditions.

The object of the present invention is thus to develop a method of treating workpieces made of hot forming tool steel, in particular direct injection nozzle bodies, to improve the nitridability of these workpieces in particular without having to pickle the workpieces and to thus avoid the disadvantages due to pickling which are known in the related art.

SUMMARY

The present invention is a method of producing a workpiece of a heat-resistant steel, in particular a hot forming tool steel, the workpiece being hardened and thereby depassivated, characterized in that the hardening step includes a reduction treatment, in particular by using hydrogen, and then according to the present invention, the tempered workpieces having the active surface are nitrided in several steps under different gas atmospheres, the nitriding being performed first in an atmosphere of ammonia and an oxidizing agent, in particular water vapor or air, and then in an atmosphere of ammonia and a carbonaceous gas, in particular endogas or a mixture containing CO and/or $CO_2$.

The advantages of the method according to the present invention for heat treatment and of heat-resistant workpieces produced in this way from hot forming tool steel, in particular direct-injection nozzle bodies, are the result in particular of eliminating the pickling treatment before nitriding. Since no pickling is performed according to the present invention, no pickling scars are formed on the surface of the workpiece. Therefore, workpieces produced in this way have very advantageous strength properties. Since the method according to the present invention greatly improves the nitridability of the workpiece surfaces, the workpieces are also characterized by extremely uniform entire internal and external nitride layers. The method according to the present invention is also much less expensive in comparison with the method known in the related art because the installations required for pickling and subsequent cleaning are eliminated, and only equipment for supplying hydrogen to the vacuum hardening installation is needed. Since no acids are used for pickling in the method according to the present invention, this definitely results in less environmental pollution, and in particular it also improves working conditions.

DETAILED DESCRIPTION

A workpiece made of a heat-resistant steel, such as a hot forming tool steel, may be hardened and thereby depassivated, and the hardening step may include a reduction treatment. This reduction may cause metal oxide layers and/or metal hydroxide layers on the surface of the workpiece to be removed, so that the subsequent nitriding may be greatly improved without having to perform pickling. The reduction treatment may be performed by using hydrogen.

In conjunction with the present invention, a hot forming tool steel is understood to be a steel which is constantly exposed to an elevated temperature during its use, in particular a temperature of more than 200° C. There must not be any structural changes in hot forming tool steel during use, but instead the structure must be sufficiently stable and must have good tempering properties. Hot forming tool steel must have different properties depending on the desired application. Important desired properties include in particular strength and hardness, which in turn determine wear resistance.

Hot forming tool steel must meet some special requirements with regard to use properties, including hot strength, which is achieved in particular by molybdenum, tungsten and fine-grained vanadium, good tempering properties, which are achieved by chromium, which together with molybdenum, nickel and manganese increases hardenability, and hot wear resistance, which may be determined by the heat strength of the matrix and by the type and amount of special carbides. Direct-injection nozzle bodies of hot forming tool steel must have a very high wear resistance, for example.

In one exemplary embodiment of the present invention, the workpiece made of a heat-resistant steel, in particular hot forming tool steel, may be mechanically machined and subjected to an electrochemical machining before hardening, i.e., to an ECM method which is performed in an electrolyte solution for shaping and surface treatment. Such a method may be used in particular for deburring, polishing, grinding and/or etching the workpiece. For example, internal bores may be produced by using an ECM method and rounding subsequently.

The workpiece may be subjected to cleaning in an aqueous cleaning medium, in particular a neutral cleaning agent, after the ECM method. The cleaning step may prevent the development of thick layers of $Me_xO_y[OH]_z$ on the surface of the workpiece. Following the cleaning step, the workpiece may be dried. Next the workpiece may be hardened immediately. In one embodiment of the present invention, the workpiece may be first preserved by suitable methods if it is to be stored for a prolonged period of time after the ECM machine; then after storage, immediately before hardening, it may be cleaned again in a liquid cleaning medium.

Hardening which results in a change in structure of the hot forming tool steel as described above may be performed in a single-chamber or multichamber vacuum furnace. Hardening may include convective heating of the workpiece under nitrogen. Convective heating of the workpiece may be performed under a nitrogen pressure greater than 0.8 bar. In another embodiment of the present invention, the workpiece may also be heated in vacuo. The workpiece may be heated at least up to the hardening temperature of the hot forming tool steel. The hardening temperature of hot forming tool steel may be approximately 1040° C.

After reaching a desired temperature, the nitrogen atmosphere or the vacuum may be replaced by hydrogen. The hydrogen thus introduced may act as a reducing agent for reduction of the layers of metal oxide and/or metal hydroxide present on the tool surface and may be introduced at a temperature of at least 400° C. However, the temperatures at which hydrogen is introduced may be in the range of the hardening temperature. The hydrogen partial pressure may be approximately 1 to 100 mbar. The flow rate of the hydrogen feed may be 100 to 2000 L/h. Austenitization may be performed over a period of 10 to 40 minutes.

In another embodiment of the present invention, the gas exchange may be performed as a pulsating operation over a period of one to ten minutes. In other words, the hydrogen partial pressure may be increased in a pulsating manner over a period of one to ten minutes in exchange with vacuum. This yields a better gas exchange, in particular with workpieces having blind boreholes.

The hydrogen may be pumped out before the end of austenitization to prevent the gas used for quenching in the following step from becoming contaminated with hydrogen.

The austenitized workpiece may be quenched in nitrogen at a pressure of 1 to 10 bar after holding it at the hardening temperature.

After hardening, in particular after quenching, the workpiece may be subjected to at least one tempering step.

The workpiece may be tempered at a temperature of up to 650° C., the tempering of the workpieces taking place either in a nitrogen atmosphere or under a nitrogen-hydrogen atmosphere. When a nitrogen-hydrogen atmosphere is used, it may contain up to 5% hydrogen. Tempering of the workpiece may be performed in a vacuum furnace or an evacuable tempering furnace. The tempering step may be performed for approximately one to two hours.

There is the possibility of the workpiece being subjected to multiple tempering steps instead of just one. In one embodiment, the workpiece may be subjected to a first tempering step which lasts approximately one to two hours, during which it is heated to a temperature of 520° C., and following that it may be subjected to a second tempering step, which may last approximately one to two hours and during which it may be heated to a temperature of 610° C.

The workpiece may be nitrided after tempering. Nitriding results in hardening of the hot forming tool steel of which the workpiece is made. This is based on diffusion of nitrogen into the steel. This results in an incorporation of nitrogen at interlattice sites and formation of nitrides and addition of nitrogen onto carbides to form carbonitrides. Nitriding results in hard boundary areas, thus increasing the hardness, wear resistance and durability of the hot forming tool steel.

The workpiece may be transferred to a nitriding furnace immediately after hardening and tempering. The nitriding furnace used may be a purged chamber furnace or an evacuable retort oven.

In one embodiment of the present invention, the workpieces in the nitriding furnace may be heated from room temperature to a temperature of approximately 400° C. in a first step. Heating of the workpieces in the nitriding furnace may be performed in an ammonia atmosphere. Then in a second step the workpiece may be heated up to the nitriding temperature, which is approximately between 500° C. and 600° C. Nitriding of the workpieces, which is performed following heating, may include the following steps:

step 1: nitriding in an atmosphere of ammonia and an oxidizing agent, step 2: nitriding in an atmosphere of ammonia and a carbonaceous substance, step 3: nitriding in an atmosphere of ammonia or a gas additive to reduce the nitriding index.

In other words, the workpiece may be nitrided in a gas atmosphere which may be changed incrementally. The oxidizing agent in step 1 may be 0.5 to 10 vol % water vapor or up to 15% air. The carbonaceous substance used in step 2 may be 1 to 10 vol % endogas. Endogas is obtained by endothermic reaction of hydrocarbons such as propane and is a mixture of 23.7 vol % CO, 31.5 vol % $H_2$ and 44.8 vol % $N_2$. In another preferred embodiment, CO and/or $CO_2$ may also be used in equivalent amounts as the carbonaceous substance. The nitriding in step 2 is referred to as gas oxycarburation and may last more than four hours or between approximately 10 to 60 hours. After the gas oxycarburation reaction, which may last more than four hours, a uniform nitride layer has already developed on the surface of the workpiece. Following step 2, i.e., in step 3, a treatment may be performed in ammonia or by adding gas to reduce the nitriding index in order to reduce the growth of connecting layers.

The gas flow rate during nitriding depends on the effective furnace volume and may amount to three times the effective furnace volume in L/h.

The workpieces may be cooled by using nitrogen after nitriding. The workpiece produced and treated by using the method according to the present invention may then be hard machined by conventional methods.

The method according to the present invention may be used to produce heat-resistant direct-injection nozzle bodies of hot forming tool steel, the nozzle body being made of high-strength heat-resistant hot forming tool steel, such as steel brands X40CrMoV51 and X38CrMoV51. The pressure chamber may be machined further, and a manufacturing cycle which includes soft machining, ECM machining and subsequent directly linked cleaning in an aqueous cleaning medium, but no pickling treatment, is performed according to the present invention. Then the direct-injection nozzle bodies may be hardened in a vacuum furnace in the temperature range between 1000° C. and 1070° C. under a pulsed hydrogen partial pressure of 1 to 100 mbar and next quenched in a stream of nitrogen gas at a pressure of 1 to 10 bar. Tempering may be performed at a temperature of up to 650° C. in a nitrogen atmosphere or a nitrogen-hydrogen atmosphere. Subsequent nitriding may be performed at 510° C. to 590° C. over a period of 10 to 60 hours using the gas oxynitrocarburation method described above in a chamber furnace or an evacuable chamber furnace. Heat-resistant direct-injection nozzles bodies treated in this way have more advantageous strength properties because the nitride layer is uniformly developed and there are no pickling scars like those described in the related art.

What is claimed is:

1. A method for producing a workpiece from a heat-resistant steel, comprising the steps of:

hardening the workpiece, including a reduction treatment to form a depassivated surface for stepwise nitriding, and convective heating of the workpiece under one of a nitrogen atmosphere and in vacuo;

nitriding the workpiece;

replacing the one of the nitrogen atmosphere and the vacuum by a hydrogen atmosphere after reaching a predetermined heating temperature; and generating the hydrogen atmosphere in a pulsating operation over a pulse period of between about one and ten minutes.

2. The method as claimed in claim 1, wherein hydrogen is used as a reducing agent.

3. The method as claimed in claim 1, further comprising machining and electrochemically treating the workpiece before the hardening step.

4. The method as claimed in claim 1, further comprising cleaning the workpiece before the hardening step.

5. The method as claimed in claim 4, further comprising drying the workpiece after the cleaning.

6. The method as claimed in claim 1, further comprising cleaning the workpiece in an aqueous cleaning medium before the hardening step.

7. The method as claimed in claim 1, wherein the hardening step includes convective heating of the workpiece under a nitrogen atmosphere with a nitrogen pressure greater than 0.8 bar.

8. The method as claimed in claim 1, wherein the heat-resistant steel includes a hot forming tool steel and wherein the workpiece is heated at least to a hardening temperature of the hot forming tool steel.

9. The method as claimed in claim 1, wherein a hydrogen partial pressure is between about 1 and 100 mbar.

10. The method as claimed in claim 1, wherein a hydrogen flow rate is between about 100 and 2000 L/h.

11. The method as claimed in claim 1, wherein the hardening step is performed in one of a single-chamber and multichamber vacuum furnace.

12. The method as claimed in claim 1, further comprising quenching the workpiece after the hardening.

13. The method as claimed in claim 12, wherein the workpiece is quenched in the quenching step using nitrogen.

14. The method as claimed in claim 12, wherein the nitrogen has a pressure of between about 1 and 10 bar.

15. The method as claimed in claim 1, further comprising tempering after the hardening.

16. The method as recited in claim 15, wherein the tempering step includes heating the workpiece up to a temperature of about 650° C.

17. The method as claimed in claim 15, further comprising heating the workpiece in a nitrogen atmosphere.

18. The method as recited in claim 15, further comprising heating the workpiece in a nitrogen-hydrogen atmosphere having a hydrogen content of up to about 5%.

19. The method as claimed in claim 15, wherein the tempering is performed in one of a vacuum furnace and an evacuable tempering furnace.

20. The method as claimed in claim 15, wherein the tempering is performed over a period of between about 1 and 4 hours.

21. The method as claimed in claim 1, further comprising in a first step heating the workpiece from room temperature up to a temperature of approximately 400° C.

22. The method as claimed in claim 21, wherein the workpiece is heated in the heating step under an ammonia atmosphere.

23. The method as claimed in claim 1, wherein the workpiece is heated up in the heating step to a nitriding temperature.

24. The method as claimed in claim 1, wherein the nitriding of the workpiece includes the steps of:

(a) nitriding under an atmosphere of ammonia and an oxidizing agent;

(b) nitriding under an atmosphere of ammonia and a carbonaceous substance; and (c) nitriding under an atmosphere of one of ammonia and a gas additive.

25. The method as claimed in claim 24, wherein the carbonaceous substance includes one of about 1 to 10 vol % endogas and CO and $CO_2$ in equal amounts.

26. The method as claimed in claim 24, wherein the oxidizing agent including one of about 0.5 to 10 vol % water vapor and up to 15% air.

27. The method as claimed in claim 1, further comprising cooling the workpiece under nitrogen after the nitriding.

28. The method as claimed in claim 1, further comprising hard machining the workpiece after cooling.

29. The method as claimed in claim 1, wherein the workpiece includes a direct-injection nozzle body.

30. The method as claimed in claim 1, wherein the heat-resistant steel includes hot forming tool steel.

* * * * *